US008491452B2

(12) United States Patent
Zess

(10) Patent No.: US 8,491,452 B2
(45) Date of Patent: Jul. 23, 2013

(54) PRESSURE ROLLS, APPARATUSES USEFUL IN PRINTING AND METHODS OF MAKING PRESSURE ROLLS

(75) Inventor: Martin Franklin Zess, Churchville, NY (US)

(73) Assignee: Xerox Corporation, Norwalk, CT (US)

( * ) Notice: Subject to any disclaimer, the term of this patent is extended or adjusted under 35 U.S.C. 154(b) by 822 days.

(21) Appl. No.: 12/549,805

(22) Filed: Aug. 28, 2009

(65) Prior Publication Data

US 2011/0053740 A1 Mar. 3, 2011

(51) Int. Cl.
*B05C 11/00* (2006.01)

(52) U.S. Cl.
USPC ..... 492/49; 492/48; 492/15; 29/895

(58) Field of Classification Search
USPC ..... 492/15, 56, 48, 49; 427/299, 402, 427/409; 156/60; 29/895
See application file for complete search history.

(56) References Cited

U.S. PATENT DOCUMENTS 3,941,635 A * 3/1976 Tavelle et al. ..... 156/86
4,064,313 A * 12/1977 Takiguchi et al. ..... 428/447
4,254,732 A * 3/1981 Moser ..... 118/60
4,430,406 A * 2/1984 Newkirk et al. ..... 430/124.35
5,035,950 A * 7/1991 Del Rosario ..... 428/421
5,534,347 A * 7/1996 Chen et al. ..... 428/375
5,766,759 A * 6/1998 Chen et al. ..... 428/375
5,807,631 A * 9/1998 Moser ..... 428/339
5,974,293 A * 10/1999 Fromm ..... 399/325
5,993,082 A * 11/1999 Verhoest et al. ..... 396/612
7,046,948 B1 * 5/2006 Zess et al. ..... 399/325

* cited by examiner

*Primary Examiner* — David Bryant
*Assistant Examiner* — Jacob Cigna
(74) *Attorney, Agent, or Firm* — Ronald E. Prass, Jr.; Prass LLP

(57) ABSTRACT

Pressure rolls for apparatuses useful in printing, apparatuses useful in printing and methods of making pressure rolls are provided. An exemplary embodiment of a pressure roll for an apparatus useful in printing includes a first layer including silicone rubber, the first layer including a first outer surface, a first end face and an opposite second end face; a second layer including a polymer overlying the first layer, the second layer including a second outer surface, a third end face and an opposite fourth end face; and a sealing material bonded to and covering the first, second, third and fourth end faces. The sealing material includes a polymer that is impervious to, and chemically resistant to, a release agent comprising silicone oil.

20 Claims, 4 Drawing Sheets

PRESSURE ROLLS, APPARATUSES USEFUL IN PRINTING AND METHODS OF MAKING PRESSURE ROLLS

BACKGROUND

Some printing apparatuses include opposed rolls that form a nip at which marking materials are fixed onto media. Liquid release agents can be supplied to the rolls by liquid delivery systems. The release agents are used to reduce adherence of media and marking materials to the rolls.

It would be desirable to provide pressure rolls that can provide an extended service life when exposed to release agents, and methods of making the pressure rolls.

SUMMARY

Pressure rolls for apparatuses useful in printing, apparatuses useful in printing and methods of making pressure rolls for apparatuses useful in printing are provided. An exemplary embodiment of a pressure roll for an apparatus useful in printing comprises a first layer comprising silicone rubber, the first layer including a first outer surface, a first end face and an opposite second end face; a second layer comprising a polymer overlying the first layer, the second layer including a second outer surface, a third end face and an opposite fourth end face; and a sealing material bonded to and covering the first, second, third and fourth end faces. The sealing material comprises a polymer that is impervious to, and chemically resistant to, a release agent comprising silicone oil.

DRAWINGS

DETAILED DESCRIPTION

The disclosed embodiments include pressure rolls for apparatuses useful in printing. An exemplary embodiment of the pressure rolls comprises a first layer comprising silicone rubber, the first layer including a first outer surface, a first end face and an opposite second end face; a second layer comprising a polymer overlying the first layer, the second layer including a second outer surface, a third end face and an opposite fourth end face; and a sealing material bonded to and covering the first, second, third and fourth end faces. The sealing material comprises a polymer that is impervious to, and chemically resistant to, a release agent comprising silicone oil.

The disclosed embodiments further include apparatuses useful in printing. An exemplary embodiment of the apparatuses comprises a first roll including a first outer surface; and a second roll including: a first layer comprising silicone rubber overlying the core, the first layer including a first outer surface, a first end face and an opposite second end face; a second layer comprising a polymer overlying the first layer, the second layer including a second outer surface forming a nip with the first outer surface, a third end face and an opposite fourth end face; and a polymeric sealing material bonded to and covering the first, second, third and fourth end faces.

The sealing material comprises a polymer that is impervious to, and chemically resistant to, a release agent comprising silicone oil.

The disclosed embodiments further include methods of making pressure rolls for apparatuses useful in printing. An exemplary embodiment of the methods comprises forming a first layer comprising silicone rubber, the first layer including a first outer surface, a first end face and an opposite second end face; wherein a second layer comprising a polymer overlies the first outer surface of the first layer, the second layer includes a second outer surface which forms the outer surface of the pressure roll, a third end face and an opposite fourth end face; and applying a polymeric sealing material to cover the first, second, third and fourth end faces. The sealing material comprises a polymer that is impervious to, and chemically resistant to, a release agent comprising silicone oil.

Figure 1:
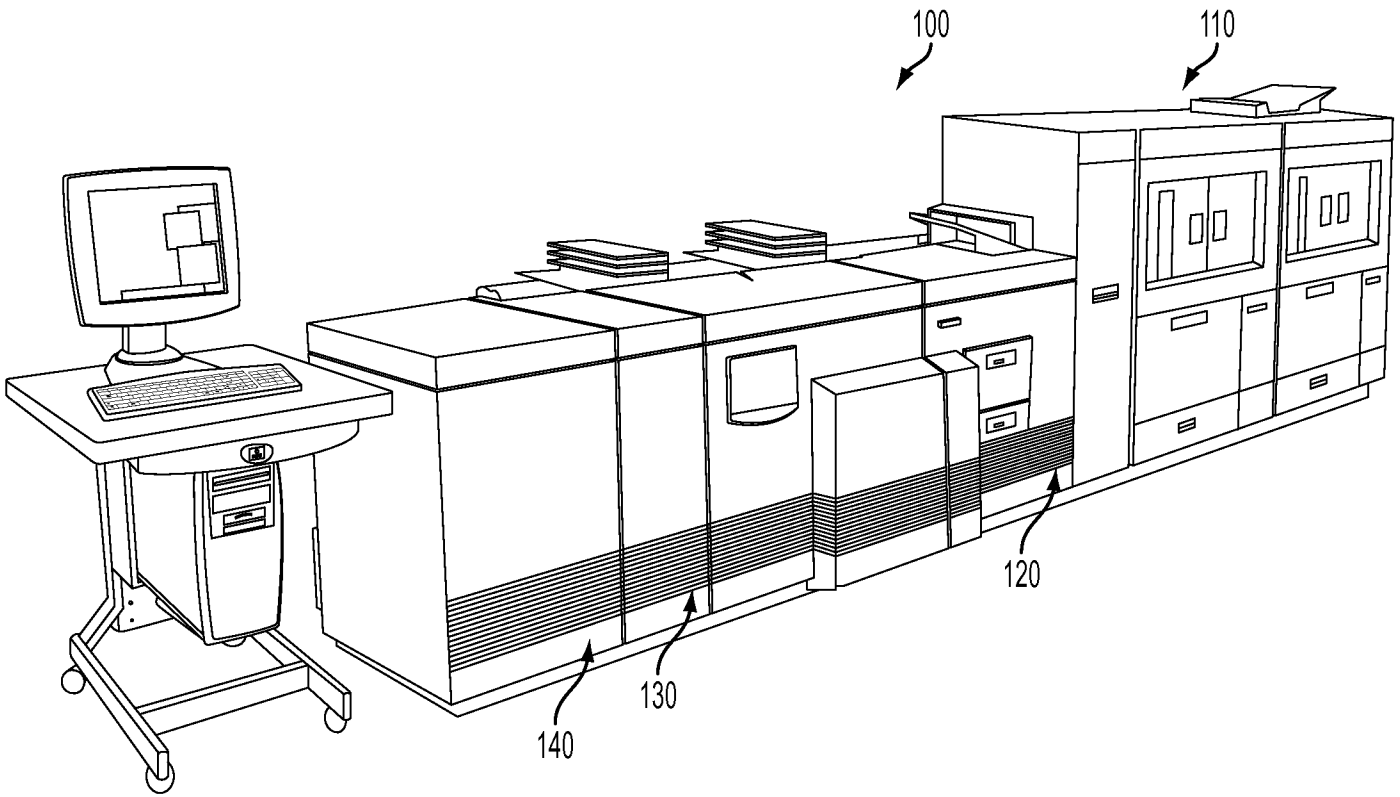
FIG. 1 illustrates an exemplary embodiment of a printing apparatus.

FIG. 1 illustrates an exemplary printing apparatus 100. As used herein, the term "printing apparatus" encompasses any apparatus, such as a digital copier, bookmaking machine, facsimile machine, multifunction machine, and the like, or portions of such apparatuses, that can perform a print outputting function for any purpose.

The illustrated printing apparatus 100 includes a media feeder and stacker section 110, paper feeder and duplexer section 120, print engine and fixing section 130, and an electronic and waste marking material collection section 140.

Figure 2:
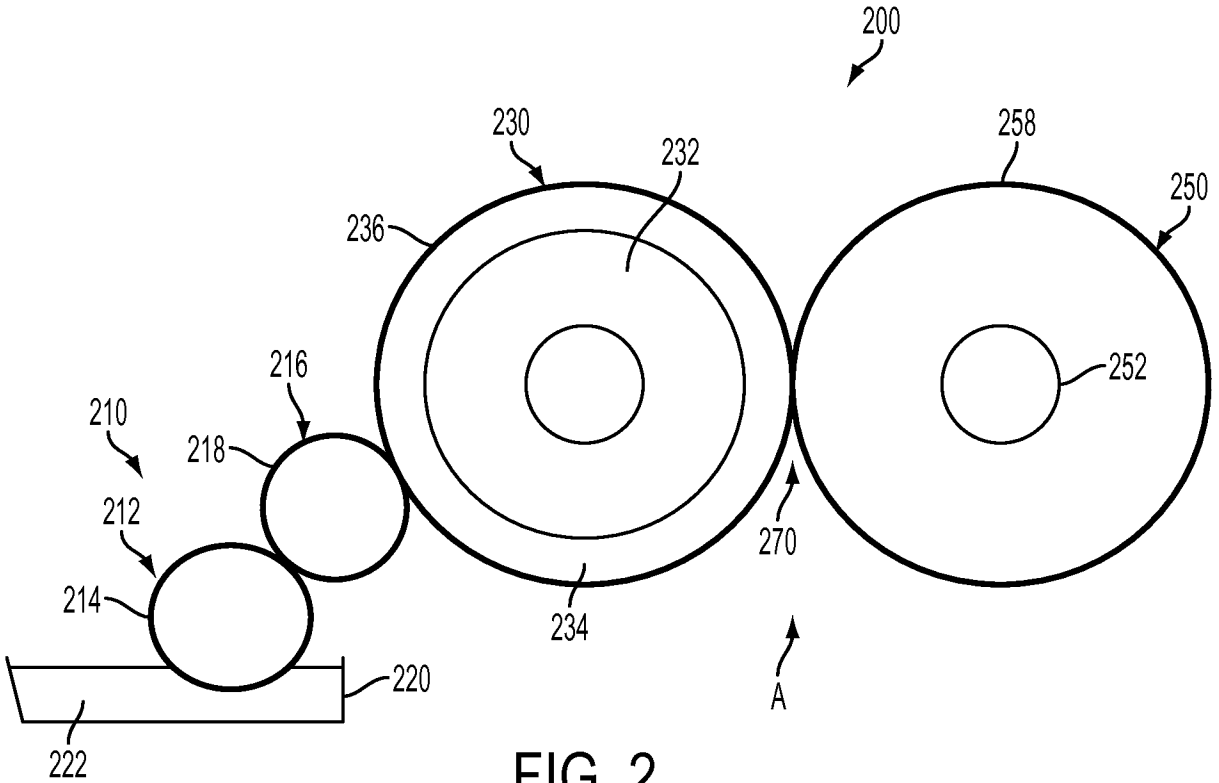
FIG. 2 illustrates an exemplary embodiment of a fixing device including a pressure roll and a fuser roll.

FIG. 2 illustrates an exemplary embodiment of a fixing device 200. The fixing device 200 can be used in different printing apparatuses, such as in the print engine and fixing section 130 of the printing apparatus 100 shown in FIG. 1. As shown in FIG. 2, the fixing device 200 includes a liquid delivery system 210, a fuser roll 230 and a pressure roll 250.

The embodiment of the fuser roll 230 includes a core 232 and a layer 234 overlying the core 232. The layer 234 includes an outer surface 236. The core 232 is typically comprised of a metal, such as aluminum, steel, or the like. The layer 234 can be comprised, e.g., of Viton® fluoroelastomer available from DuPont Performance Elastomers, or the like. The fuser roll 230 can include at least one internal heating element inside the core 232 (not shown) for heating the outer surface 236 to the desired temperature to fix marking material onto media.

As shown in FIG. 2, the pressure roll 250 includes an outer surface 258. The outer surface 236 of the fuser roll 230 and the outer surface 258 of the pressure roll 250 forms a nip 270. In the illustrated orientation of the fixing device 200, media are fed upwardly to the nip 270 in the process direction A. At the nip 270, the fuser roll 230 and pressure roll 250 apply heat and pressure to fix marking material onto the media.

Figure 3:
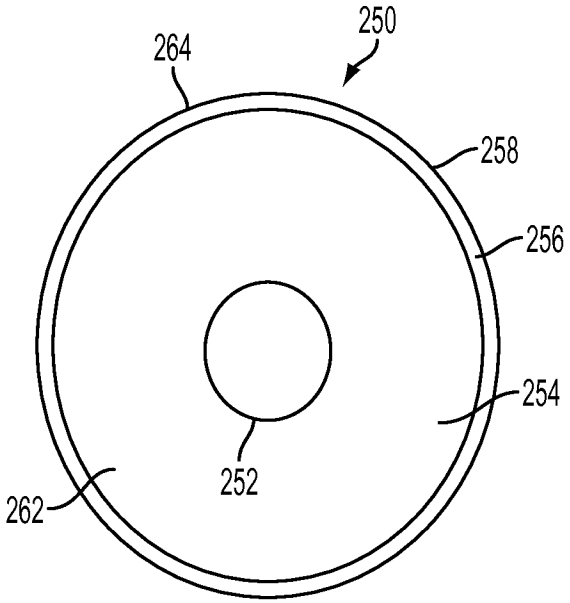
FIG. 3 illustrates an end view of an exemplary embodiment of a pressure roll in the direction of line 3-3 shown in FIG. 4.

The embodiment of the pressure roll 250 shown in FIG. 3 includes a cylindrical core 252, an inner layer 254 on the core 252, and an outer layer 256 on the inner layer 254. The inner layer 254 includes opposed end faces 262 and the outer layer 256 includes opposed end faces 264. The opposed end faces 262 of the inner layer 254 are each co-planar with corresponding opposed end faces 264 of the outer layer 256, as illustrated in FIGS. 3 and 4.

The core 252 can be comprised of a metal, such as aluminum, steel, or the like; the inner layer 254 can be comprised of an elastomeric material, such as silicone rubber (e.g., liquid silicone rubber), or the like; and the outer layer 256 can be comprised of a material having a low coefficient of friction, such as polytetrafluoroethylene (Teflon®), or the like. The inner layer 254 can be molded over the core 252 and then cured. The outer layer 256 can be a sleeve, for example.

Figure 4:
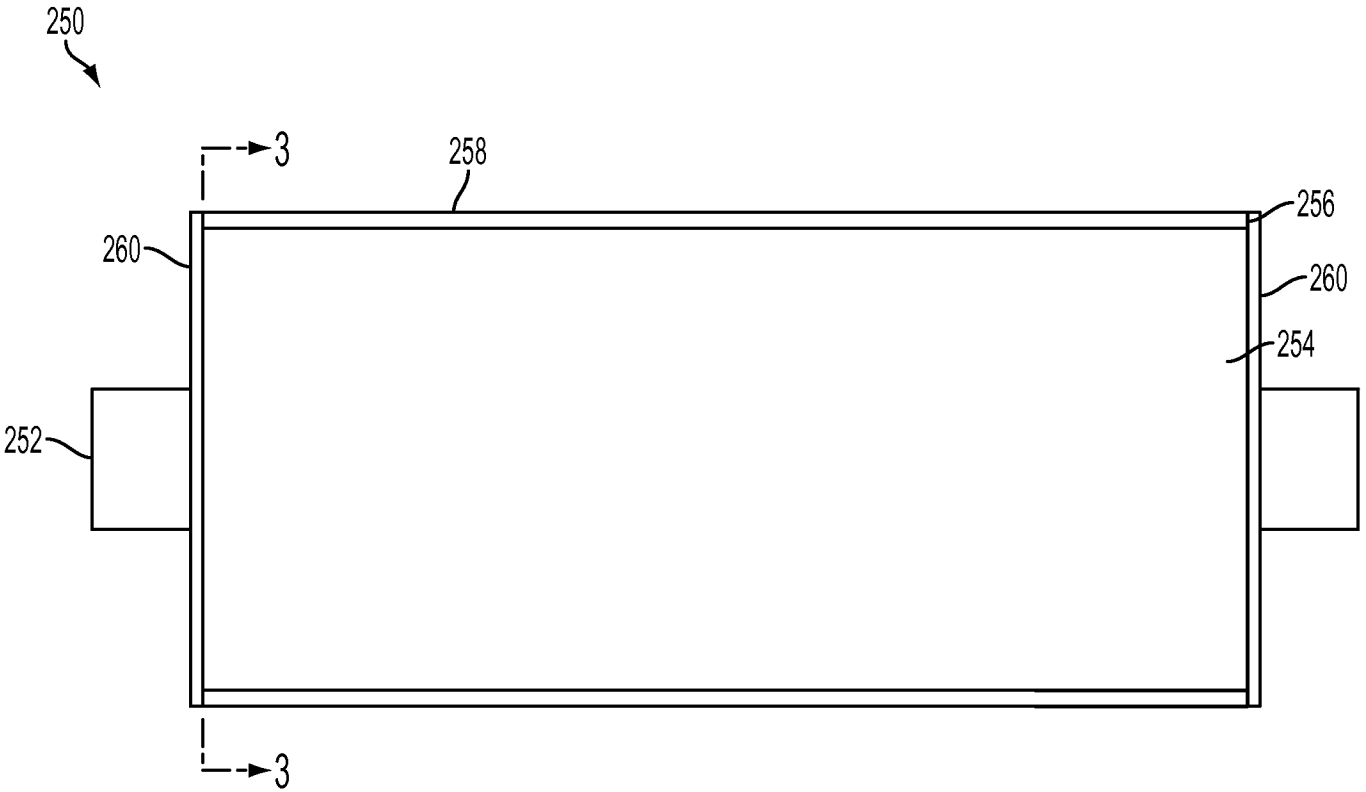
FIG. 4 is a side view of the pressure roll of FIG. 3.

As shown in FIG. 4, the pressure roll 250 includes a sealing material 260 covering the opposed end faces 262 of the inner layer 254 and the opposed end faces 264 of the outer layer 256.

The liquid delivery system 210 delivers liquid to the outer surface 236 of the fuser roll 230. The liquid is a release agent that reduces adherence of media and marking materials on the media (e.g., toner or inks) to the outer surface 236 of the fuser roll 230 and the outer surface 258 of the pressure roll 250 as the media pass through the nip 270. For example, the liquid release agent can comprise silicone oil, or the like. The liquid release agent can also contain additives, such as amines, to provide the desired chemical properties to the release agent.

The liquid delivery system 210 includes a first roll 212 having an outer surface 214 and a second roll 216 having an outer surface 218. The outer surface 214 and outer surface 218 can each be comprised of either a non-compressible material or a compressible (elastically deformable) material.

The non-compressible material can be, e.g., a metal, such as aluminum or steel, while the compressible material can be, e.g., an elastomeric material. Exemplary compressible materials that can be used include silicone, a fluoroelastomer sold under the trademark Viton® by DuPont Performance Elastomers, L.L.C., and like polymers.

As shown, the liquid delivery system 210 includes a sump 220 configured to contain a liquid release agent 222. The first outer surface 212 contacts the release agent 222 contained in the sump 220. The first roll 212 is rotated to convey the release agent 222 from the sump 220 to the outer surface 218 of the second roll 216. The second roll 216 is rotated to transfer the release agent from the outer surface 218 to the outer surface 232 of the fuser roll 230.

It is desirable to control the amount of the release agent 222 supplied to the outer surface 232 of the fuser roll 230 by the liquid supply system 210. This control can be provided by, e.g., varying the rotational speed of the first roll 212 and the second roll 216. The amount of the release agent placed on media can be varied depending on the media image content. For example, a smaller amount of release agent can be placed on media that carry text-based images, while a larger amount of release agent can be placed on media that carry other types of images.

In the fixing device 200 shown in FIG. 2, the outer surface 236 of the fuser roll 230 can be profiled to make the speed of media passing through the nip 270 uniform along the axial direction of the fuser roll 230.

In embodiments, the inner layer 254 and outer layer 256 of the pressure roll 250 can be relatively softer than the layer 234 of the fuser roll 230. Media fed to the nip 270 can be inboard or outboard registered, for example, with respect to the outer surface 232 of the fuser roll 230 and the outer surface 258 of the pressure roll 250. The outer surface 258 of the pressure roll 250 can have a length of about 14 inch, for example. It has been noted that media, such as plain and coated paper, having a length dimension less than 14 inches, such as 11 inches, as well as media having a length dimension of about 14 inches, do not sufficiently remove excess silicone oil contained in the release agent from the outer surface 258 of the pressure roll 250. The outer surface 236 of the fuser roll 230 can be sloped or shaped along the axial direction of the fuser roll 230 to allow media to pass through the nip 270 without being damaged. Increasing pressure from this slope exerted between the outer surface 236 of the fuser roll 230 and the outer surface 258 of the pressure roll 250 can cause excess silicone oil to migrate axially towards and onto both axial ends of the pressure roll 250.

It has further been noted that when the pressure roll 250 does not include the sealing material 260 covering the end faces 262 of the inner layer 254 and the end faces 264 of the outer layer 256 (i.e., the end faces 262, 264 are exposed), silicone oil can permeate into liquid silicone rubber forming the inner layer 254. The silicone oil in the release agent can cause the silicone rubber of the inner layer 254 to swell and degrade physical properties of the silicone rubber. This degradation can reduce the modulus of the silicone rubber, leaving it softer and less rigid at the axial ends of the pressure roll 250 as compared to the intermediate portion of the pressure roll 250 between the axial ends. This difference in modulus between different portions of the pressure roll 250 can cause the inner layer 254, and accordingly the pressure roll 250, to fail catastrophically. Swollen pressure rolls can also cause the release agent to be dispersed inside of apparatuses, which can necessitate cleaning and associated downtime of the apparatuses. It has been noted that this problem is more severe in apparatuses in which media having a length dimension of 11 inches are predominately run, as compared to apparatuses in which longer media, such as media having a length of 14 inches, are predominately run, due to a greater build-up of excess release agent at the inboard end of the pressure roll (for outboard-registered media) when such shorter media are used.

In embodiments, the sealing material 260 is effective to protect the end faces 262 of the inner layer 254 and the end faces 264 of the outer layer 256 from exposure to the release agent applied to the fuser roll 230 by the liquid supply system 210. For example, when the release agent comprises silicone oil and the inner layer 254 is comprised of a material that is degraded by contact with silicon oil, such as liquid silicone rubber, the sealing material 260 selected is impermeable and chemically resistant to silicone oil so that the material forming the inner layer 254 is protected from the silicone oil.

The sealing material 260 forms a liquid seal at the interface between the sealing material 260 and end faces 264 of the outer layer 256 of the pressure roll 250. The liquid seal prevents the release agent from getting between the sealing material 260 and the end faces 264 and reaching the end faces 262 of the inner layer 254. The sealing material 260 also prevents the release agent from reaching the end faces 262 of the inner layer 254 at the inner circumference of the sealing material 260 overlying the core 252 of the pressure roll 250. That is, the sealing material 260 can form a liquid seal from the outer surface of the core 252 to the outer surface 258 of the outer layer 256.

The sealing material 260 can be any suitable material that provides the desired properties in the fixing device 200. In embodiments, the sealing material 260 is chemically resistant to the release agent applied to the fuser roll 230. The sealing material 260 can maintain its sealing capability when exposed to silicone oil. The sealing material 260 is sufficiently elastic to be compatible with the elasticity of material forming the inner layer 254, e.g., silicone rubber. In embodiments, the sealing material 260 is sufficiently thin to be bonded directly, or via one or more intermediate layers, to the inner layer 254 and outer layer 256 substantially without changing the ability of the inner layer 254 to deform in the desired manner in the apparatus.

An exemplary material that can be used as the sealing material 260 contains a fluoropolymer, which is chemically resistant to the release agent, and silicone. The fluoropolymer can be Viton®, or the like. This material is impervious to silicone oil. The sealing material 260 can be applied to the inner layer 254 and outer layer 256 as a formulation containing, e.g., a fluoropolymer graft solution and one or more processing additives, such as curing agents (e.g., organophosphonium salt and bisphenol AF and an activator/vulcanizer, such as calcium hydroxide, or the like).

In other embodiments, other polymeric materials that are impervious to silicone oil; can be bonded to silicone rubber used to form the inner layer 254 and the material used to form the outer layer 256 of the pressure roll 250; and have sufficient elasticity when bonded to withstand the material flexing and pressures that occur at the nip 270, may also be used as the sealing material 260 in the pressure roll 250.

The sealing material 260 can be applied to the end faces 262 of the inner layer 254 and the end faces 264 of the outer layer 256 by any suitable technique that enables a sufficiently-strong bond to be formed between the materials and which forms a liquid seal. For example, the sealing material can be a thin coating applied onto the outer surface of the inner layer 254 by any suitable coating technique. Following coating, the sealing material is thermally treated, as appropriate, to harden the material.

In other embodiments, the sealing material 260 can be pre-formed and then adhered with a suitable adhesive to the inner layer 254 and outer layer 256. For example, the sealing material 260 can have a disc shape. In the embodiments, the pre-formed material is sufficiently thin to be bonded to the inner layer 254 and outer layer 256 without changing the ability of the inner layer 254 to deform. The adhesive is compatible with the properties of the sealing material 260 and the materials of the inner layer 254 and outer layer 256.

In embodiments, the end faces 262, 264 can be chemically or physically treated before applying the sealing material 260 to enhance the bond strength of the sealing material 260 to the end faces 262, 264. For example, the end faces 262, 264 can be plasma treated, or mechanically roughened to enhance the bond strength of the sealing material 260.

In embodiments, by sealing the end faces 262, 264, the service life of the pressure roll 250 can be increased, and downtime of the apparatus can be decreased.

It will be appreciated that various ones of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. A pressure roll for an apparatus useful in printing, comprising:

a first layer comprising silicone rubber, the first layer including a first outer surface, a first end face and an opposite second end face;

a second layer comprising a polymer overlying the first layer, the second layer including a second outer surface, a third end face co-planar with the first end face and an opposite fourth end face co-planar with the second end face; and a sealing material bonded to and covering the first, second, third and fourth end faces, the sealing material comprising a polymer that is impervious to, and chemically resistant to, a release agent comprising silicone oil.

2. The pressure roll of claim 1, wherein the sealing material comprises a fluoropolymer chemically resistant to the release agent and silicone.

3. The pressure roll of claim 1, wherein:

the first layer overlies a metal core; and the second layer comprises polytetrafluoroethylene.

4. The pressure roll of claim 1, wherein:

the first layer overlies an outer surface of a core; and the sealing material forms a liquid seal to the outer surface of the core and to the first, second, third and fourth end faces.

5. An apparatus useful in printing, comprising:

a first roll including a first outer surface; and a second roll including:

a first layer comprising silicone rubber overlying a metal core, the first layer including a first outer surface, a first end face and an opposite second end face;

a second layer comprising a polymer overlying the first layer, the second layer including a second outer surface forming a nip with the first outer surface of the first roll, a third end face co-planar with the first end face and an opposite fourth end face co-planar with the second end face; and a polymeric sealing material bonded to and covering the first, second, third and fourth end faces, the sealing material comprising a polymer that is impervious to, and chemically resistant to, a release agent comprising silicone oil.

6. The apparatus of claim 5, wherein the sealing material comprises a fluoropolymer chemically resistant to the release agent and silicone.

7. The apparatus of claim 5, wherein:

the first layer overlies a metal core; and the second layer comprises polytetrafluoroethylene.

8. The apparatus of claim 5, wherein:

the first layer overlies an outer surface of a core; and the sealing material forms a liquid seal to the outer surface of the core and to the first, second, third and fourth end faces.

9. The apparatus of claim 5, wherein the first roll comprises at least one internal heating element for heating the first outer surface.

10. The apparatus of claim 5, wherein the first outer surface of the first roll is sloped or shaped along an axial direction of the first roll to allow media to pass through the nip without being damaged.

11. The apparatus of claim 5, further comprising a liquid supply system including:

a sump containing the release agent;

a third roll contacting the release agent contained in the sump; and a fourth roll contacting the third roll and the second outer surface of the second roll;

wherein the third roll is rotatable to convey the release agent from the sump to the fourth roll, and the fourth roll is rotatable to convey the release agent to the second outer surface of the second roll.

12. A method of making a pressure roll for an apparatus useful in printing, comprising:

forming a first layer comprising silicone rubber, the first layer including a first outer surface, a first end face and an opposite second end face;

wherein a second layer comprising a polymer overlies the first outer surface of the first layer, the second layer includes a second outer surface which forms the outer surface of the pressure roll, a third end face co-planar with the first end face and an opposite fourth end face co-planar with the second end face; and applying a polymeric sealing material to cover the first, second, third and fourth end faces, the sealing material comprising a polymer that is impervious to, and chemically resistant to, a release agent comprising silicone oil.

13. The method of claim 12, wherein the sealing material comprises a fluoropolymer chemically resistant to the release agent and silicone.

14. The method of claim 13, wherein the sealing material is applied to the first, second, third and fourth end faces by a coating technique.

15. The method of claim 12, wherein:

the first layer overlies a metal core; and the second layer comprises polytetrafluoroethylene.

16. The method of claim 12, wherein:

the first layer overlies an outer surface of a core; and the sealing material forms a liquid seal to the outer surface of the core and to the first, second, third and fourth end faces.

17. The method of claim 12, further comprising treating the first, second, third and fourth end faces before applying the sealing material thereto to increase the bond strength of the sealing material to the first, second, third and fourth end faces.

18. The method of claim 17, wherein the treating comprises mechanically roughening the first, second, third and fourth end faces.

19. The method of claim 17, wherein the treating comprises chemically treating the first, second, third and fourth end faces.

20. The method of claim 12, wherein the sealing material is pre-formed and adhesively bonded to the first, second, third and fourth end faces with an adhesive.

* * * * *